US005347899A

United States Patent [19]

Schultz et al.

[11] Patent Number: 5,347,899

[45] Date of Patent: Sep. 20, 1994

[54] SLOT CUTTER

[75] Inventors: David Schultz, Grand Haven; Donald E. Heinz, West Olive, both of Mich.

[73] Assignee: M & S Tool and Die Company, Grand Haven, Mich.

[21] Appl. No.: 62,452

[22] Filed: May 11, 1993

[51] Int. Cl.[5] ..... B26D 1/06; B26D 7/02

[52] U.S. Cl. ..... 83/50; 83/54; 83/183; 83/188; 83/277; 83/409; 83/437

[58] Field of Search ..... 83/206, 277, 183, 188, 83/424, 409, 54, 50, 178, 437, 440.1, 444, 465, 638, 39

[56] References Cited

U.S. PATENT DOCUMENTS

| | | | |
|---|---|---|---|
| 1,054,143 | 2/1913 | Plost | 83/178 X |
| 2,781,843 | 2/1957 | Comstock | 83/271 X |
| 3,266,352 | 8/1966 | Kuts | 83/54 X |
| 3,266,356 | 8/1966 | Seravin et al. | 83/183 X |
| 3,546,992 | 12/1970 | Muller | 83/417 |
| 3,619,883 | 11/1971 | Venables, III | 269/35 |
| 3,677,121 | 7/1972 | Etchell | 83/437 |
| 4,192,209 | 3/1980 | Urbanski | 83/564 |
| 4,250,782 | 2/1981 | Munker | 83/638 X |
| 4,426,899 | 1/1984 | Long et al. | 83/277 X |
| 4,638,703 | 1/1987 | Muhr | 83/518 |
| 4,744,276 | 5/1988 | Duce | 83/50 |
| 5,020,578 | 6/1991 | Jennings | 83/409 X |
| 5,193,374 | 3/1993 | Castricum | 83/54 X |

*Primary Examiner*—Richard K. Seidel
*Assistant Examiner*—Kenneth E. Peterson
*Attorney, Agent, or Firm*—Varnum, Riddering, Schmidt & Howlett

[57] ABSTRACT

An apparatus for punching a line of apertures in a workpiece having a channel. The apparatus comprises a punch press mounted to a base over a work space, a removable punch tool mounted on the punch press, an elongated table slidably mounted to the base having a line of travel extending through the work space, a mandrel, a clamping mechanism on the table for clamping a workpiece thereon with the workpiece channel aligned with the mandrel, and a drive mechanism for selectively moving the table in increments as the punch press sequentially strokes. When the workpiece is clamped to the table, it will be incrementally drawn along the mandrel, the mandrel being in the channel, and repeatedly punched by the punch tool, as the table is moved through the work space.

12 Claims, 9 Drawing Sheets

SLOT CUTTER

BACKGROUND OF THE INVENTION

1. Field of the Invention

This inventions relates to the field of hydraulically actuated cutting and punching, and more particularly to an apparatus for punching holes and slots in tubes or channels.

2. State of the Prior Art

Shelving systems and office furniture often employ punched tubing as an adjustable mounting surface for shelving, work surfaces, and other furniture components. Such punched tubing typically comprises a U-shaped channel or square box beam having a plurality of equally spaced slots along its length. Several rows of slots may be provided in a single tube. Clips on a shelf bracket or other furniture component are adapted to fit into one or more slots in the tube to support the shelf bracket or other piece of equipment. A typical application comprises a pair of vertically oriented slotted tubes, mounted to the studs in an office wall, having shelf brackets mounted thereon and extending outwardly therefrom, and a shelf supported on top of the shelf brackets. Slotted tubes are also used for many other applications in the furniture and other industries.

Generally, slotted tubes are produced by punching slots into a preformed U-shaped channel or box beam workpiece. A punch press cycles vertically up and down to force a cutting tool through the material of the workpiece, thus punching out a piece of material to form a slot of predetermined size. A mandrel supports the underside of the workpiece and has a recess sized to receive the cutter as it passes through the workpiece, aiding the cutter to make a clean cut through the workpiece material. Several slots may be cut with each cycle of the punch press, but the workpiece must generally be fed longitudinally under the punch press in a controlled series of steps so that repeated punches by the punch press produce slots along the entire length of the workpiece. The longitudinal motion of the workpiece must be accurately controlled so that successive slots are cut accurately; the required tolerance is generally only a few thousandths of an inch. Several machines and methods have been proposed to accurately align the workpiece under the cutters.

U.S. Pat. No. 4,744,276 to Duce, issued May 17, 1988 discloses one method and apparatus for punching apertures in the walls of the square sectioned steel tubes. A punching machine comprises a power punch having a punch head which is movable in a vertically up and down direction upon operation of a foot pedal. The machine supports a long square section mandrel which is sized to fit neatly into the interior of a square sectioned tube placed thereon. A laterally movable drive sleeve is mounted on the mandrel for controlling the position of the tube relative to the mandrel. The tube slides along the mandrel, yet is not securely gripped in any fashion.

In practice, the tube is pushed over the mandrel until it engages the drive sleeve and continues until the drive sleeve is in the most rearward position. The drive sleeve then pushes the tube forwardly a predetermined distance to properly position the tube under the punch head. The press is stroked by depression of the pedal so that the punch head moves downwardly, causing a punch pin on the punch head to punch out an appropriately shaped aperture. The tube is then moved forwardly along the mandrel by means of the drive sleeve until it is properly positioned to punch the next aperture.

Proper positioning of subsequent apertures is aided by means of a pin extending downwardly from the punch head a predetermined distance from the punch pin, and which fits into the previously punched aperture, thus ensuring that subsequent apertures will be punched a predetermined distance apart. Because the tube is loose on the mandrel, a slight positioning adjustment is possible by the alignment pin. The pin alignment method, however is not well suited to rapid punching.

A related problem in punch presses in general is the access to the work area. U.S. Pat. No. 4,192,209 to Urbanski, issued Mar. 11, 1980 discloses a portable reduced sized hydraulic cutter and punch assembly which is designed an adapted to cut and punch a cable tray in the field. Each cable tray comprises two opposing C-shaped channels with support members disposed at predetermined intervals between the channels. The support members prevent the channel from being moved longitudinally through the work area, requiring a means to access the work area from an alternate direction.

The Urbanski machine comprises an upper pivotable assembly rotatably mounted to a fixed lower assembly. The upper assembly comprises a cylinder. A cutoff blade and assorted punches mount to and are adapted for vertical operation by means of the cylinder. The rotational operation of the upper assembly allows an operator to insert one channel of the cable tray into the machine, stroke the cylinder to punch and cut in a single operation, rotate the upper assembly open, flip the cable tray to insert the opposing channel into the machine, rotate the upper assembly closed and punch and cut the opposing channel. The cable tray is not moved longitudinally through the work area. Rather, the pivoting upper assembly permits manual insertion of different sections of the cable tray into the machine for punching, and must be opened for each stroke of the punch press.

SUMMARY OF THE INVENTION

In accordance with the invention, as embodied and broadly described herein, an apparatus for punching a line of apertures in a workpiece having a channel comprises a base having a portion defining a work space, a punch press mounted to the base over the work space, and a punch tool on the punch press. An elongated table is slidably mounted to the base and adapted to reciprocate on a line of travel between a first position where most of the table is on one side of the work space, and a second position where most of the table is on another side of the work space. The line of travel extends through the work space. A mandrel is fixed to the base and disposed within the work space over the table. The mandrel has a punch recess in register with the punch tool, adapted to receive the punch tool. A clamping mechanism on the table for clamps a workpiece to the table with the workpiece channel aligned with the mandrel. A drive means selectively moves the table in increments as the punch press sequentially strokes, so that when the workpiece is clamped to the table, it will be incrementally drawn over the mandrel, the mandrel being received in the channel, and repeatedly punched by the punch tool, as the table is moved between the first position and the second position.

Preferably the clamping mechanism comprises at least one elongated rail mounted on the table and slidable relative to the table between clamping and release positions in the line of travel, a first bracket fixedly mounted to the table and having a portion extending over the rail, a second bracket fixedly mounted to the rail and spaced from the first bracket to accommodate the length of the workpiece, and an actuator mounted to the table and operatively connected to the rail to slide the rail along the line of travel, so that when a workpiece has been placed on the rail between the first bracket and the second bracket and the actuator is energized, the workpiece will be clamped between the first bracket and the second bracket.

Preferably, the mandrel rests on the rail and has a support rod parallel to the line of travel and extending to a point on the base beyond the limit of travel of the table when the table is in the first position. The first and second brackets each have a through space, and the support rod extends through the through space.

Preferably, the actuator comprises an hydraulic cylinder. Also, the drive means preferably comprises an hydraulic cylinder and a controller to control incremental actuation of the hydraulic cylinder.

Preferably, the punch press is pivotably mounted to the base. The punch tool is removably mounted to the punch press.

Further, a carriage can be mounted to the base in a position to extend over the table when the table is in the first position, the carriage being adapted to load and unload the table with workpieces. The carriage is slidably mounted to the base for movement in a direction perpendicular to the line of travel. It has at least two workpiece holders, one for holding a finished workpiece and the other for holding an unfinished workpiece so that as the carriage moves in a direction perpendicular to the line of travel, it can remove a workpiece from and add a workpiece to the table.

A method of making a line of apertures in a workpiece having a channel comprises the steps of: positioning the workpiece on a movable table; clamping the workpiece to the table; moving the table incrementally through a punch press while simultaneously drawing the workpiece over a mandrel so that the mandrel is received within the channel; and punching at least one aperture in the workpiece after each incremental movement of the table.

BRIEF DESCRIPTION OF THE DRAWINGS

The invention will now be described with reference to the accompanying drawings in which.

DETAILED DESCRIPTION OF THE DRAWINGS

Figure 1:
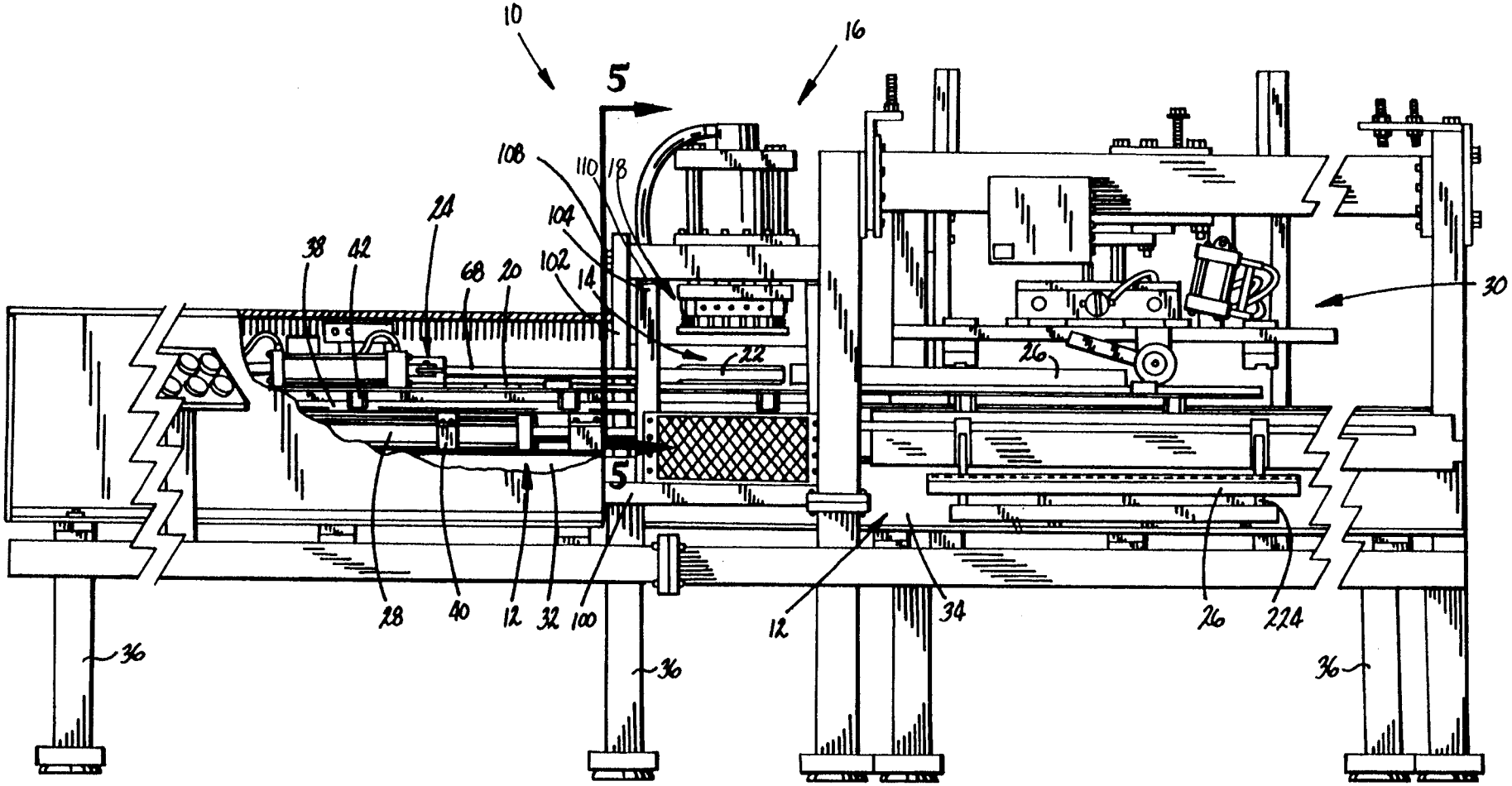
FIG. 1 is a front elevational view of a slot cutter according to the invention.

Referring now to the drawings, and to FIG. 1 in particular, a slot cutter 10 according to the invention is shown. The slot cutter 10 generally comprises a base 12, having a portion thereof defining a work space 14; a punch press 16 mounted to the base 12 over the work space 14 and having a punch tool 18; an elongated workpiece table 20 slidably mounted to the base 12; at least one mandrel 22 fixed to the base 12 and disposed within the work space 14 over the table 20; a clamping mechanism 24 on the table 20 for clamping a workpiece to the table; and a drive mechanism 28 for incrementally moving the table 20 as the punch press 16 sequentially strokes. A loading mechanism 30 accepts a supply of workpieces 26 and feeds them onto the table 20 for punching in a manner to be described hereinafter.

The base 12 comprises two substructures 32, 34 supported on a framework of legs 36. The drive substructure 32 is positioned to the left of the work space 14 as viewed in FIG. 1, and supports the drive mechanism 28. The feed substructure 34 is located to the right of the work space 14 as viewed in FIG. 1, and supports the loading mechanism 30. A series of stanchions 40 projecting upwardly from the base 12 supports a pair of parallel, horizontally disposed, longitudinal Thompson rails 38 running substantially the length of the apparatus.

The table 20 is slightly longer than one-half the length of the slot cutter 10 and is slidably mounted to the base 12 by a series of opposing arms 42 projecting downwardly from the underside of the table 20. Looking briefly at FIGS. 5 and 6, it will be seen that each arm terminates in a semicircular bearing 44 which fits over a Thompson rail 38 to slidably support the table 20. The rail bearings 44 can be provided with nylock bushings, roller bearings or other suitable antifriction devices to permit the bearings 44 to slide easily on the Thompson rails 38. Thus, the table 20 is mounted to slidably reciprocate along a line of travel parallel to the rails 38 and through the work space 14, between a first position where most of the table is over the drive substructure 32 and a second position where most of the table is over the feed substructure 34. It will be understood that at all times, a portion of the table 20 will be in the work space 14.

Figure 2:
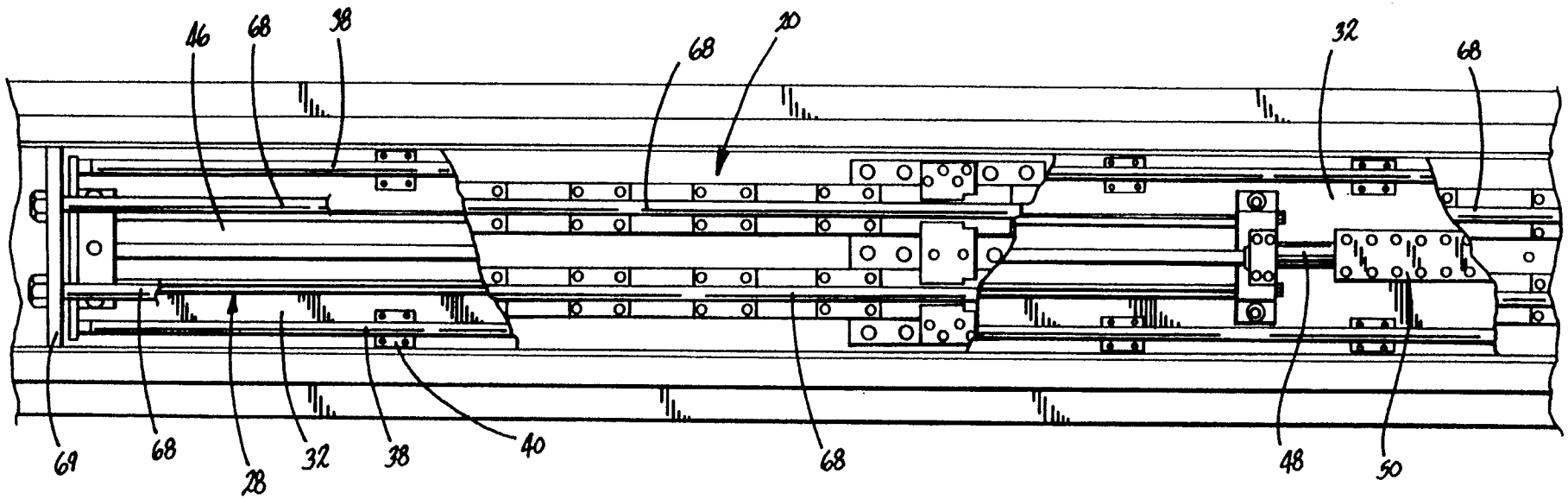
FIG. 2 is a plan view of a portion of the slot cutter of FIG. 1 with parts cut away to show the drive mechanism.

Turning now also to FIG. 2, the drive mechanism 28 is secured to the base 12 within the drive substructure 32 and comprises a horizontally disposed, longitudinal hydraulic cylinder 46 having a piston shaft 48 extending therefrom towards the work space 14. Preferably, the cylinder 46 is a linear electrohydraulic servo-actuator of the type manufactured and sold, for example, under the trade name LESA TM by Vickers T-J of Jackson, Mich. A table bracket 50 at the outer end of the shaft 48 attaches securely to the underside of the table 20. The table 20 is thus slidably movable on the Thompson rails 38 in response to actuation of the cylinder 46.

Figure 3:
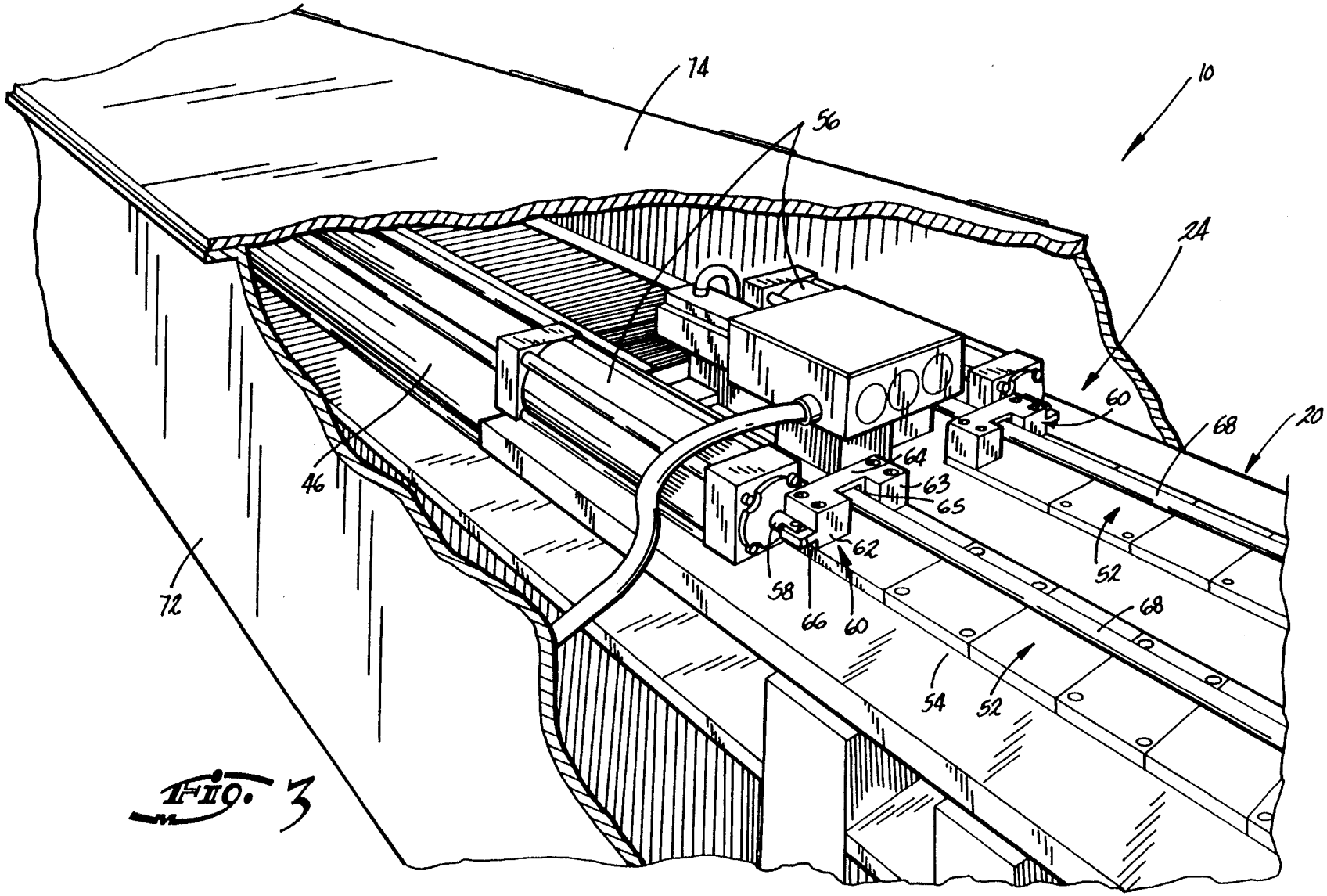
FIG. 3 is a perspective view of a portion of the slot cutter of FIG. 1, with parts cut away to show a portion of the workpiece table.
Figure 4:
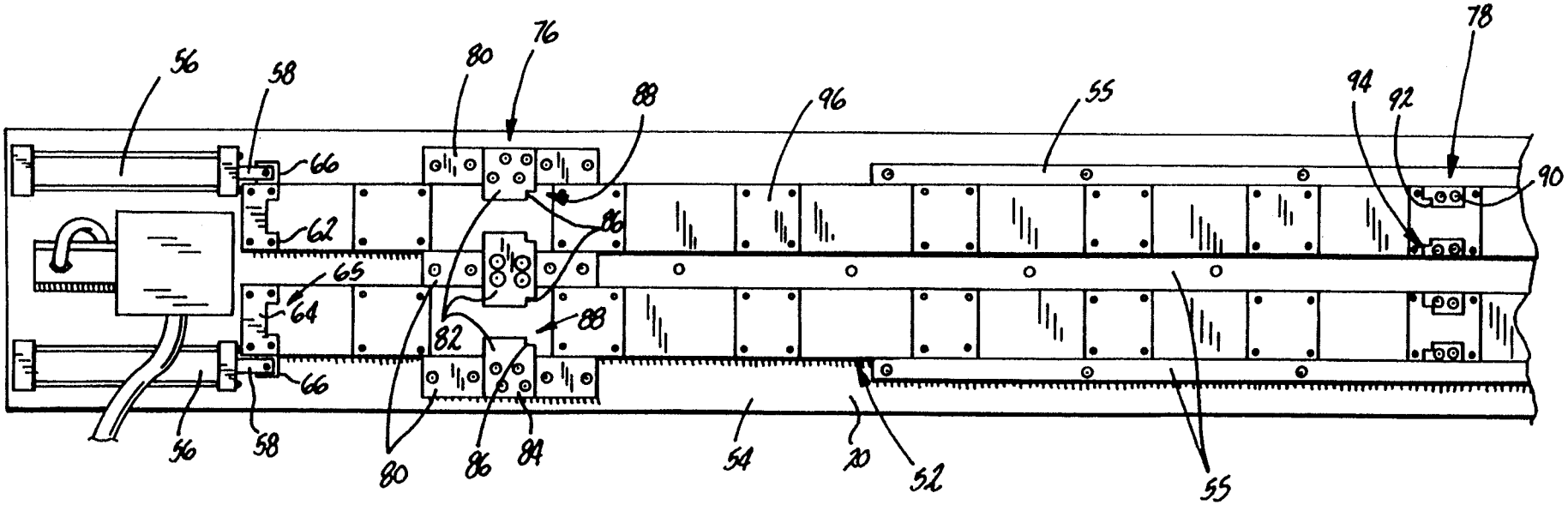
FIG. 4 is a plan view of a portion of the workpiece table of FIG. 3.

Turning now also to FIGS. 3 and 4, the clamping mechanism 24 comprises a pair of parallel, longitudinally slidable sections 52 on the table upper surface 54. Each slidable section 52 can be on the surface 54 of the table 20 as shown in FIG. 3, or can be level with or recessed below the upper surface 54, sliding within a mating channel in the table. Although a pair of slidable sections 52 are shown in FIG. 3, each slidable section 52 is adapted to independently clamp a single workpiece 26. It will be understood that any number of slidable sections can be provided in the slot cutter 10 to enable punching of multiple workpieces at the same time. Slidable motion of each section 52 is restricted to motion along the line of travel of the table 20 by guide members 55 which are secured to the upper surface 54.

Each slidable section 52 extends substantially the entire length of the table 20. A pair of clamping cylinders 56 is fixedly mounted to the end of the table 20 which is disposed within the drive substructure 32. Each cylinder 56 is connected to a corresponding slidable section 52 and provides a limited amount of longitudinal movement of the section 52 relative to the table as will be more fully described hereinafter. The cylinders 56 are slightly offset from their corresponding slidable sections 52. A piston shaft 58 extends from each cylinder 56, parallel to the slidable section 52, and connects to a bracket 60 securely mounted to one end of the slidable section 52.

Each bracket 60 comprises two upright portions 62 and 63, spaced apart and secured as by welding to the upper surface of the respective slidable section 52. A bridge 64 laterally extends between the two upright portions 62, 63 thereby defining a space 65. A mounting tab 66 extends laterally outwardly from the upright portion 62 to connect the bracket 60 to the piston shaft 58. A mandrel support rod 68 is connected at one end to a bracket 69 on the frame 12 and extends therefrom longitudinally of the slot cutter through the space 65 over each slidable section 52 to a point near or within the work space 14. The function of the mandrel support rods 68 will be further described hereinafter. Each of the clamping cylinders 56 is hydraulic and operated independently of the drive cylinder 46.

The portion of the slot cutter 10 supported by the drive substructure 32 is preferably enclosed by a shroud or housing 72. The housing 72 comprises a hinged top cover 74 to provide ready access to the interior.

Looking more closely at FIG. 4, the clamping mechanism 24 further comprises a stop bracket 76 mounted to the table 20 and an end bracket 78 mounted to the slidable section 52. The brackets 76, 78 are disposed to clamp a workpiece securely between them on a slidable section 52, and thus the table 20. A workpiece typically comprises an elongated tube or channel member.

The stop bracket 76 comprises a pair of base portions 80 mounted to the table 20 on either side of a slidable section 52. Where the table 20 comprises a pair of slidable sections 52, as shown in FIG. 4, three aligned base portions 80 are mounted to the table adjacent the slidable sections 52. Cantilevers 82 are mounted to each base portion 80 and extend over the adjacent slidable section 52. Opposing cantilevers 82 are spaced apart a sufficient distance that the mandrel support rod 68 and the mandrel 22 mounted on the end of the mandrel support rod 68 will fit therebetween. A small notch 86 is located on a corner of the portion of each cantilever 82 overhanging the adjacent slidable section 52. The notches 86 define a receiving surface 88 against which an end of the workpiece 26 will abut.

The end bracket 78 on each slidable section 52 comprises a pair of opposed plates 90 fixedly mounted to the slidable section 52 and spaced apart a sufficient distance to receive the mandrel support rod 68 and the mandrel 22 therebetween. Notches 92 are provided on a corner of each plate 90 to define a receiving surface 94 against which an end of the workpiece will abut.

Each slidable section 52 is provided with removable inserts 96 at spaced locations along its length. Any one of the inserts 96 can be removed and replaced by an insert carrying an end bracket 78 in order to roughly approximate the length of a given workpiece.

Clamping a workpiece is accomplished by actuating the clamping cylinders 56 to move a slidable section 52 in a direction where the end bracket 78 moves away from the stop bracket 76 (to the right in FIG. 4). A workpiece is then placed on the slidable section 52 between the two brackets 76, 78 and aligned to abut the corresponding receiving surfaces 88, 94. The clamping cylinder 56 is then actuated in the opposite direction to move the slidable section carrying the workpiece and the end bracket 78 toward stop bracket 76 (to the left in FIG. 4). When the ends of the workpiece are securely engaged by the receiving surfaces 88, 94 on both the stop bracket 76 and end bracket 78, respectively, the workpiece will be securely clamped therebetween.

Returning again to FIG. 1, each mandrel support rod 68 has a threaded end in or near the work space 14. A mandrel 22 is threaded onto each end of the mandrel support rod 68 in a position to be disposed within the work space 14 and rest on a corresponding slidable section 52 of the table 20. As the table 20 moves between the first and second positions, the mandrel 22 remains fixed, and the slidable section 52 carried by the table 20 reciprocates beneath the mandrel 22 with the mandrel 22 and its support rod 68 passing between the plates 90 of the end bracket 78 and the base portions 80 of the stop bracket 76. An industry standard water-soluble oil is typically applied to the interface between the mandrel 22 and the table 20 to minimize friction.

Figure 5:
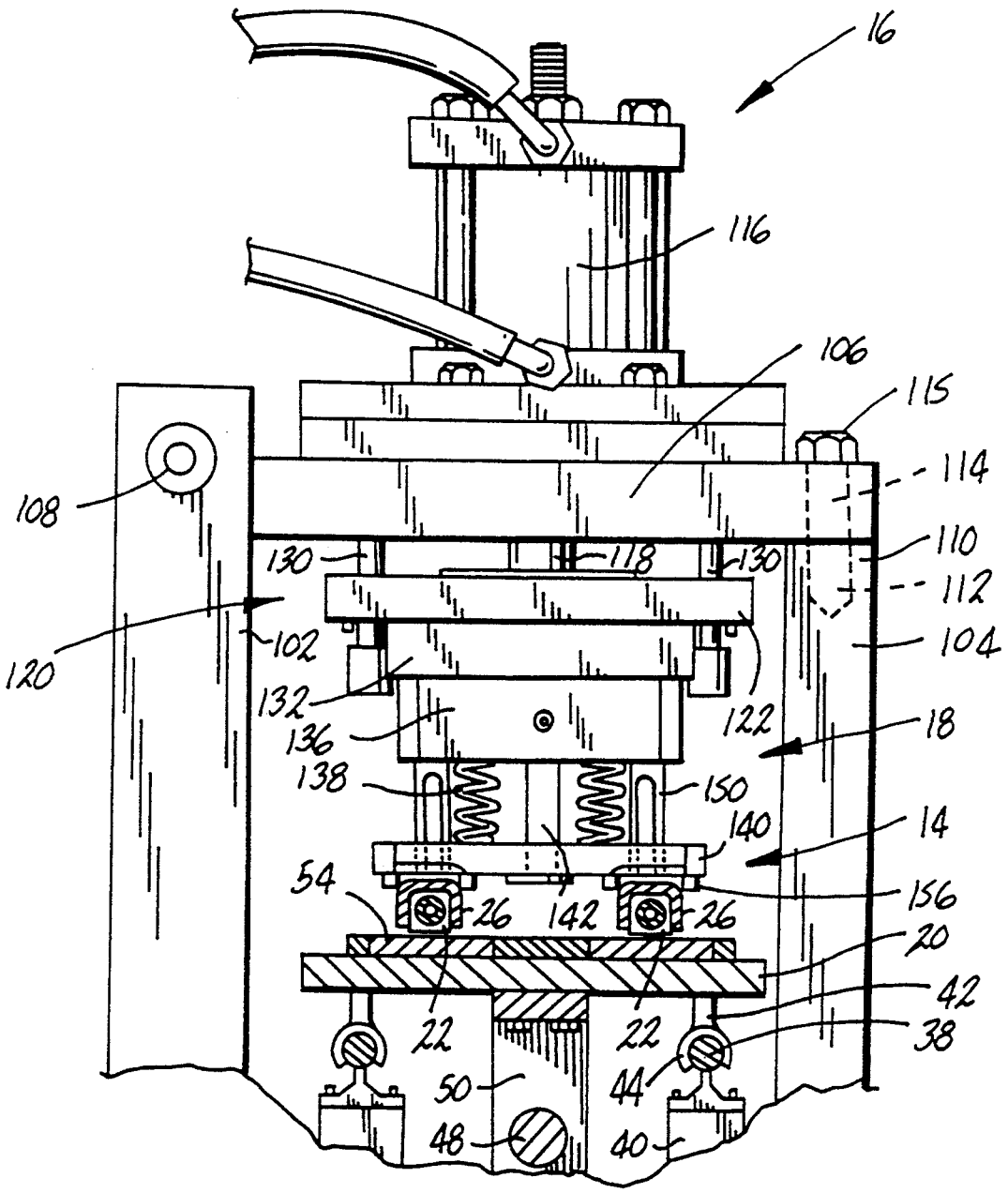
FIG. 5 is a sectional view taken along lines 5—5 of FIG. 1.

Looking now more closely at FIGS. 1 and 5, and looking more closely at the work space 14, the base 12 supports two rear posts 102 and two front posts 104 extending upwardly to generally define the work space. The rear posts 102 are slightly taller than the front posts 104, and the front posts 104 are slightly closer together than the rear posts 102. The punch press 16 is pivotably mounted to the rear posts 102.

The punch press 16 comprises a mounting plate 106 which is pivotably mounted to the rear posts 102 by pins 108. When the mounting plate 106 is pivoted downwardly to extend over the work space 14, it rests upon upper ends 110 of the front posts 104. Each front post 104 has a threaded hole 112 positioned to align with a corresponding aperture 114 in the mounting plate 106 so that the mounting plate 106 can be secured in a horizontal position over the work space 14 by machine bolts 115.

The punch press 16 further comprises a hydraulic cylinder 116 mounted atop the mounting plate 106 which has a piston shaft 118 extending through the mounting plate 106. A punch platen 122 is securely mounted to the end of the piston shaft 118 and parallel to the mounting plate 106. The platen 122 reciprocates toward and away from the mounting plate 106 as the hydraulic cylinder 116 is actuated. A pair of guide pins 130 extend downwardly from the mounting plate 106 and through bushed apertures 131 in the platen 122 in order to maintain accurate directional reciprocation of the platen 122.

Figure 6:
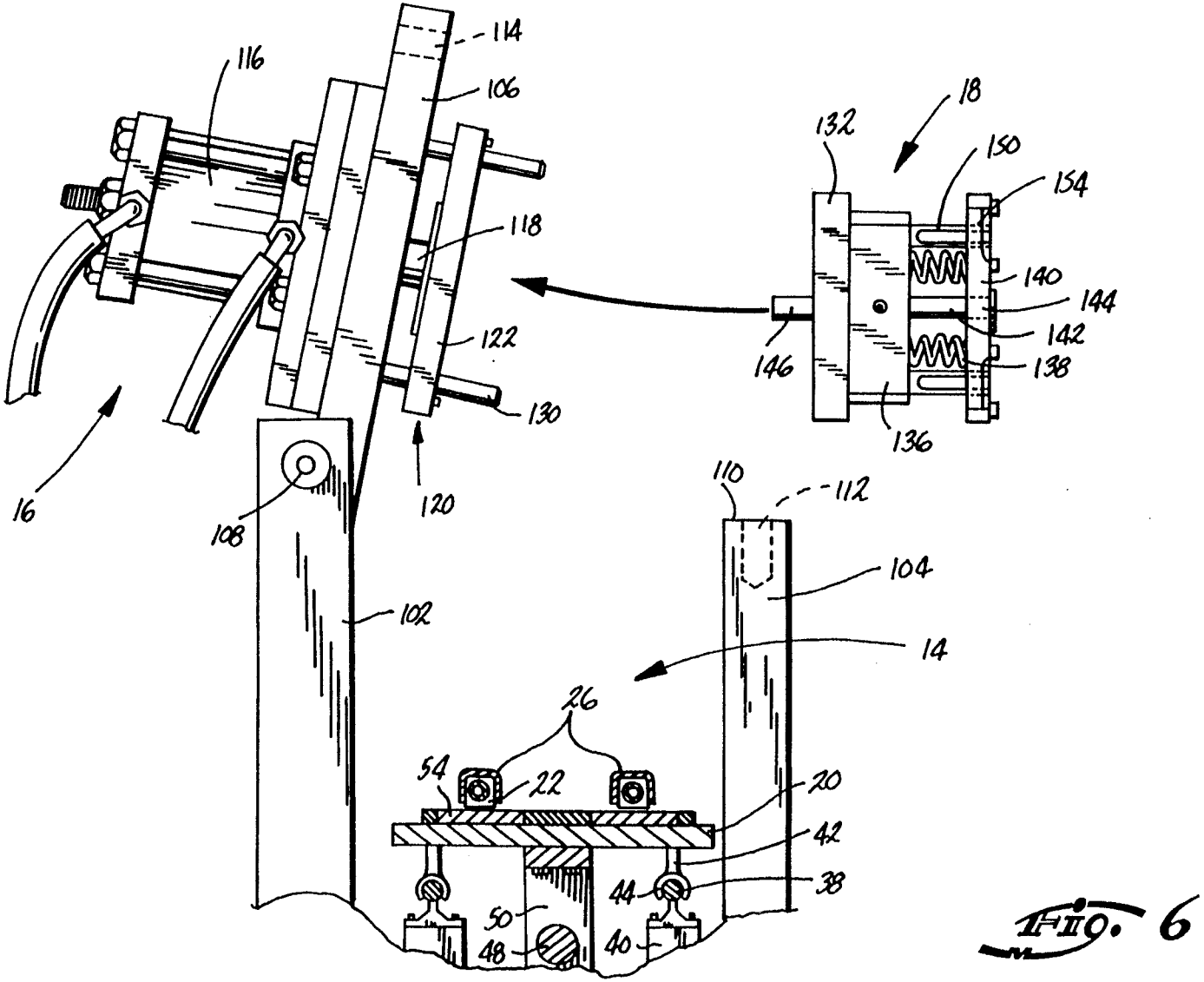
FIG. 6 is a sectional view similar to FIG. 5, but showing the punch press in the open position.
Figure 7:
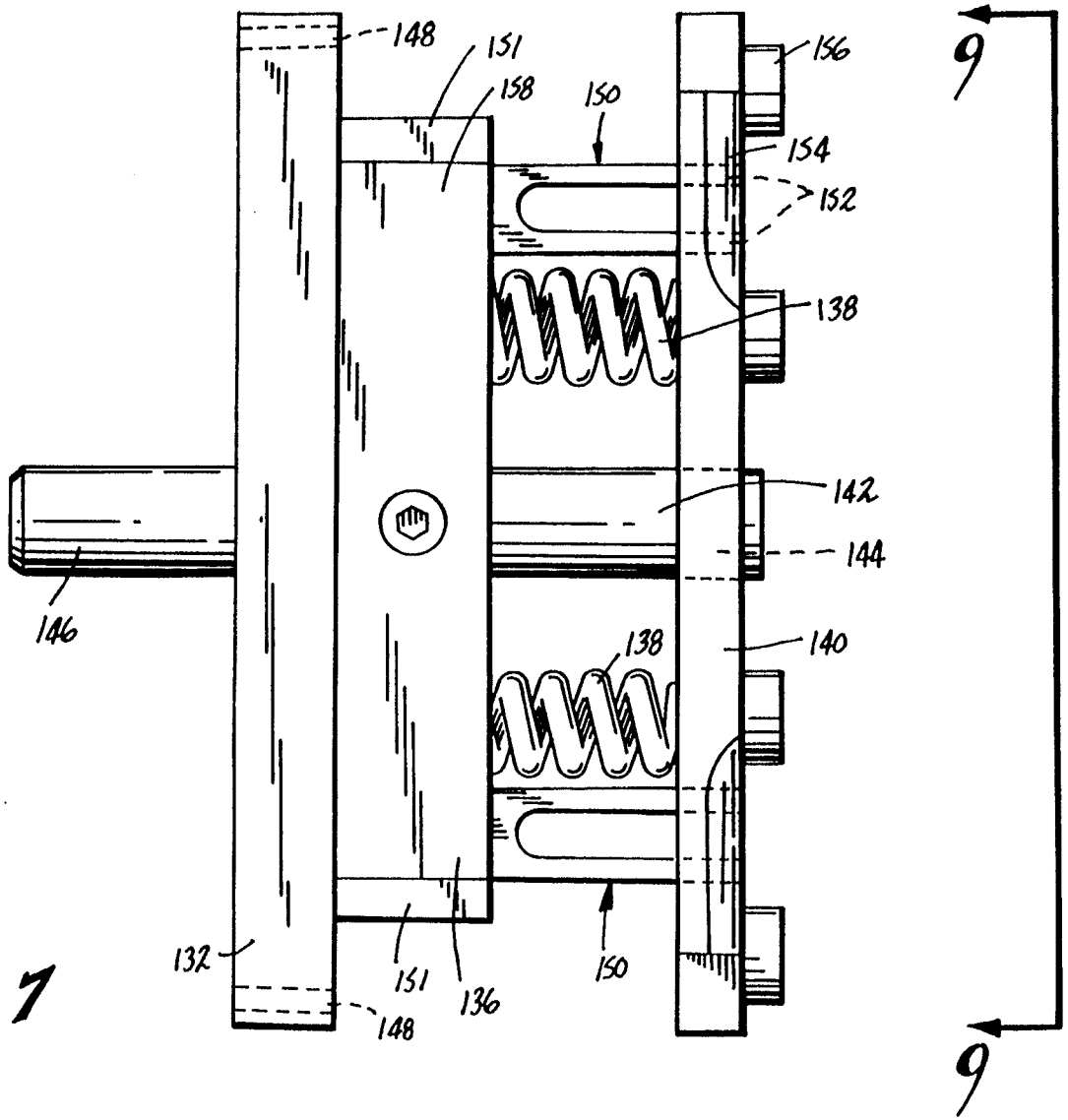
FIG. 7 is a detailed view of the punch tool of FIGS. 5 and 6.
Figure 9:
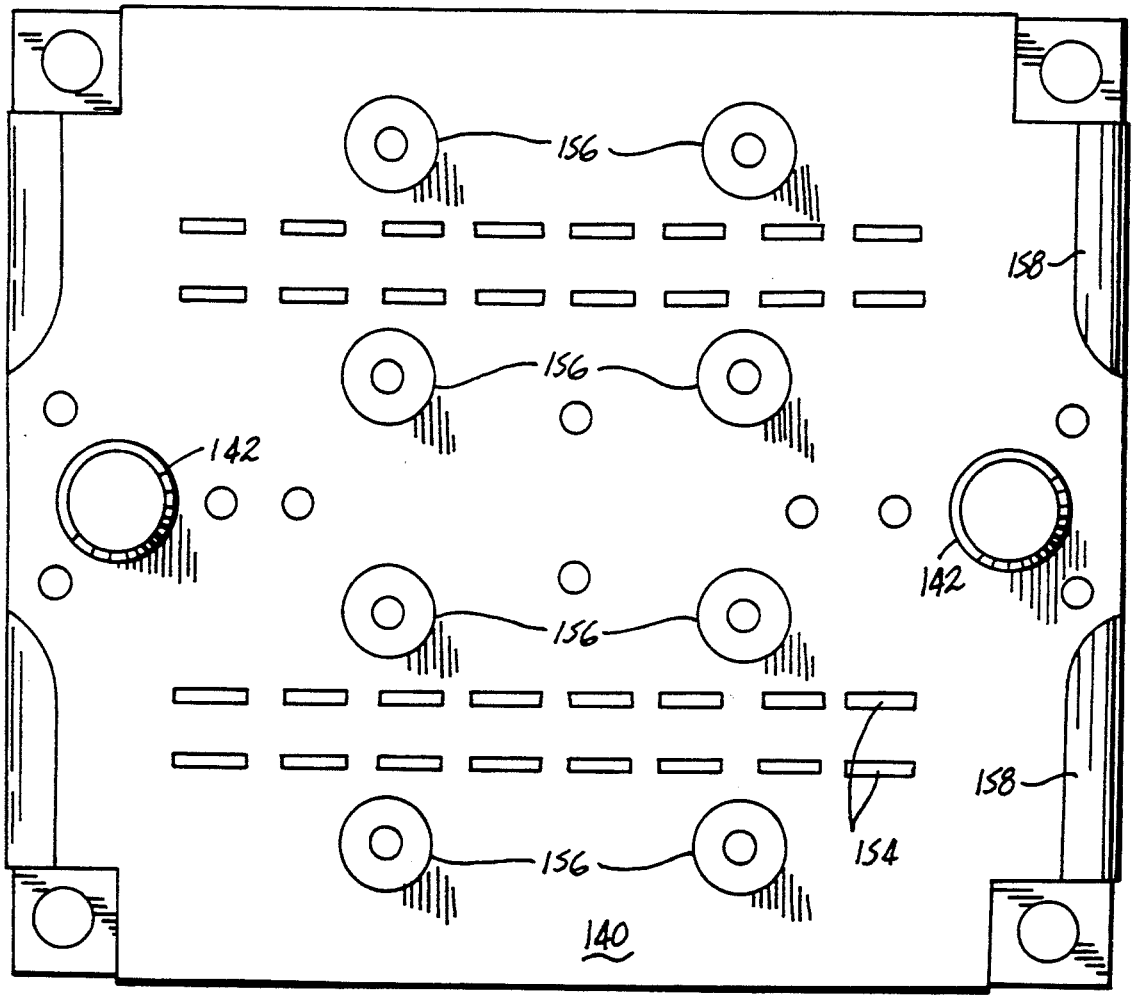
FIG. 9 is a view of the punch tool of FIG. 7 taken along lines 9—9.

Looking now also at FIGS. 6, 7, and 9, the punch tool 18 comprises an upper plate 132 with a pair of mounting pins 146 extending upwardly therefrom. The upper plate 132 further has a number of bolt holes 148 for securely bolting the punch tool 18 to the platen 122. The plate 132 is sized to fit between the guide pins 130 extending through the platen 122. A mounting block 136 is securely fixed to the surface of the upper plate 132 opposite the mounting pins 146. A pair of guide pins 142 extend downwardly from the mounting block 136. A plurality of springs 138 connect a hold-down plate 140 to the mounting block, and bias the hold-down plate 140 away from the mounting block 136. The guide pins 142 extend through mating bushed apertures 144 in the hold-down plate 132 and guide reciprocal movement of the hold-down plate relative to the mounting block 136.

Two rows of cutters 150 extend downwardly from the mounting block 136. Each cutter 150 is received in a corresponding seat in the mounting block 136, and the cutters 150 are securely held therein by a rail 151. Each cutter 150 is provided with one or more cutting surfaces 152, depending upon the configuration of slots or holes desired in the workpiece. Each row of cutters corresponds to a single workpiece in a clamping mechanism. The number of rows of cutters 150 thus correspond to the number of clamping mechanisms 24 (see FIG. 9). Apertures 154 in the hold-down plate 140 are aligned with each cutting surface 152. Guide rollers 156 are provided on the lower surface of the hold-down plate 140 to facilitate holding and guiding a workpiece as it moves on the table 20 through the work space 14. Edges of the hold-down plate 140 also have sloped portions 158 to facilitate guiding a workpiece beneath the plate 140.

The punch tool 18 can be easily mounted to and dismounted from the platen 122. Multiple punch tools 18 can be provided with different cutting tools, in different arrangements, with different dimensions to accommodate a variety of different types of workpieces. The easy accessibility to the work space 14 provided by the pivotable punch press 16 permits easy exchange of punch tools 18. Each punch tool 18 is bolted to the platen 122 by bolts extending through apertures 148 into the platen 122 with the mounting pins 146 received in mating holes in the platen 122.

Turning again to FIG. 5, in operation, the hydraulic cylinder 116 is actuated to extend the piston shaft 118 downwardly. Downward movement of the piston shaft 188 causes corresponding downward movement of the platen 122, which carries the entire punch tool downwardly with it. The workpieces 26 are securely clamped to the table 20 which has moved along the Thompson rails 38 to a position where the mandrels 22 are disposed within or beneath the workpieces 26. As the punch tool 18 continues to move downwardly, the hold-down plate 140 contacts the workpieces, with the workpieces securely guided between the rollers 156. The springs 138 bias the hold-down plate 140 tightly against the workpieces 26 to hold them firmly for the punching operation. Continued downward movement of the punch tool 18 causes the cutting surfaces 152 to proceed through the apertures in the hold-down plate 140 and into the workpieces. Continued downward movement of the punch tool 18 causes the cutting surfaces 152 to move through the workpieces, thereby punching the appropriate slots, and into mating holes in the mandrel 22 which ensure that the cutters 150 provide clean openings through the workpiece 26. To complete a cycle, the cylinder 116 moves the platen upwardly, which withdraws the cutters 150 from the mandrel, the workpieces, and into the apertures 154 of the hold-down plate 140. Continued upward movement of the platen 122 withdraws the hold-down plate 140 from the workpieces 26. Simultaneously, the drive mechanism 28 is actuated to move the table 20 and carry the workpieces 26 to an indexed position to receive a new stroke from the punch tool 18.

Figure 8:
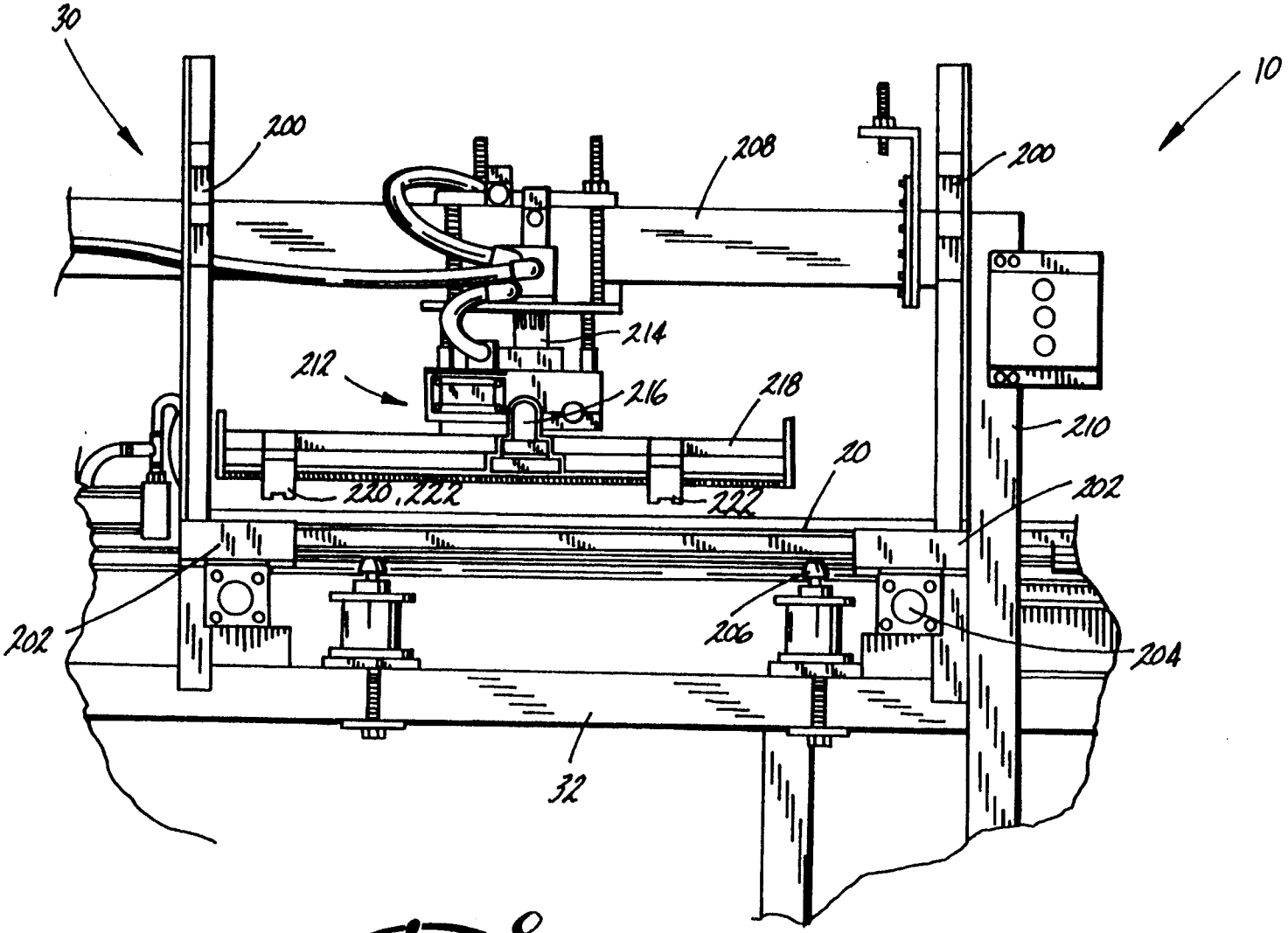
FIG. 8 is a rear elevational view of a portion of the slot cutter of FIG. 1, showing the loading mechanism.

FIG. 8 shows a loading mechanism 30 for feeding workpieces 26, such as channels or tubes, into the slot cutter 10 for punching one or more lines of apertures in the workpieces. The loading mechanism 30 comprises two pairs of L-shaped channels 200 into which opposing ends of workpieces may be inserted so that the operator can pre-load a number of workpieces for punching thereof. Each channel 200 is L-shaped so that the workpieces are inserted horizontally and then move downwardly therein. Horizontal receiving plates 202 at the lower ends of the channels 200 limit the downward travel of the workpieces 26 within the channels.

A loading channel cylinder 204 mounts underneath each stop plate 202 and connects to the loading channels 200 to provide reciprocal horizontal transverse movement of the loading channels 200. As the channels 200 move forwardly from over the stop plates 202, a workpiece falls out of each of the channels onto receiving posts 206 which extend upwardly from a frame member. The workpieces are then in position to be placed upon the table 20.

A horizontal, longitudinal beam 208 is supported above the feed substructure 32 by a frame 210, and a lifting mechanism 212 depends from the beam 208. The lifting mechanism 212 comprises a vertical cylinder 214 which raises and lowers the lifting mechanism 212, a horizontal cylinder 216 which moves the lifting mechanism 212 forwardly and rearwardly, and a horizontal longitudinal lifting beam 218. A front and rear pair of electromagnets 220, 222 depend from opposite ends of a lifting beam 218. The rear pair of magnets 222 are adapted to pick up a pair of unpunched workpieces 26 from the receiving posts 206, while the front pair of magnets 220 simultaneously pick up a pair of punched workpieces 26 from the table 20.

After the workpieces 26 are lifted by the front and rear electromagnets 220, 222 by means of the vertical cylinder 214, the horizontal cylinder moves the lifting bar 218 forwardly until the fresh workpieces 26 are above the table 20 and corresponding slidable sections 52, and the finished workpieces 26 are positioned over an off-loading ramp 224 in front of the slot cutter 10 (see FIG. 1). The vertical cylinder 214 then lowers the workpieces 26 and releases them when the electromagnets 220, 222 are deactivated.

All of this occurs, of course, when the table is in the second position so that the clamping mechanisms 24 are disposed beneath the loading mechanism 30.

Once fresh workpieces 26 are loaded onto the table 20, the clamping mechanisms 24 are engaged to firmly clamp the workpieces 26 to the table 20. The table 20 is then drawn toward the first position, through the work space 14. During this motion, the workpieces 26 are drawn over the mandrels, either in the workpiece channels, or within the longitudinal space in the box beam of the workpieces 26. As the table approaches the first position, the workpieces 26 are positioned within the work space 14 to commence the punching operation.

The repeated sequence of punching by the punch tool 18, and indexing of the position of the workpiece 20 by the linear electrohydraulic servo-actuator is controlled by a microprocessor which can be programmable.

Reasonable variation and modification are possible within the scope of the foregoing disclosure and drawings without departing from the spirit of the invention, as defined in the accompanying claims.

The embodiments of the invention in which an exclusive property or privilege is claimed are as follows:

1. An apparatus for punching a line of apertures in a workpiece having a channel, said apparatus comprising:

a base having a portion thereof defining a work space, a punch press mounted to the base over the work space, said punch press having a punch tool, an elongated table slidably mounted to the base and adapted to reciprocate on a line of travel between a first position wherein most of the table is on one side of the work space, and a second position wherein most of the table is on another side of the work space, said line of travel extending through the work space, a mandrel fixed to the base and disposed within the work space over the table, said mandrel having a punch recess in register with the punch tool and adapted to receive the punch tool, a clamping mechanism on the table for clamping a workpiece thereon with the workpiece channel aligned with the mandrel, and drive means for selectively moving the table in increments as the punch press sequentially strokes, whereby when the workpiece is clamped to the table, it will be incrementally drawn over the mandrel, the mandrel being received in the channel, and repeatedly punched by the punch tool, as the table is moved between the first position and the second position.

2. An apparatus according to claim 1 wherein the clamping mechanism comprises at least one elongated rail mounted on the table and slidable relative to the table between clamping and release positions in the line of travel, a first bracket fixedly mounted to the table and having a portion extending over the rail, a second bracket fixedly mounted to the rail and spaced from the first bracket to accommodate the length of the workpiece, and an actuator mounted to the table and operatively connected to the rail to slide the rail along the line of travel, whereby when a workpiece has been disposed on the rail between the first bracket and the second bracket and the actuator is energized, the workpiece will be clamped between the first bracket and the second bracket.

3. An apparatus according to claim 1 wherein the mandrel rests on the rail and has a support rod parallel to the line of travel and extending to a point on the base beyond the limit of travel of the table when the table is in the first position.

4. An apparatus according to claim 3 wherein the first and second brackets each have a through space, and the support rod extends through the through space.

5. An apparatus according to claim 2 wherein the actuator comprises an hydraulic cylinder.

6. An apparatus according to claim 1 wherein the drive means comprises an hydraulic cylinder and a controller to control incremental actuation of the hydraulic cylinder.

7. An apparatus according to claim 1 wherein the punch press is pivotably mounted to the base.

8. An apparatus according to claim 7 wherein the punch tool is removably mounted to the punch press.

9. An apparatus according to claim 1 further comprising a carriage mounted to the base in a position to extend over the table when the table is in the first position, said carriage being adapted to load and unload the table with workpieces.

10. An apparatus according to claim 9 wherein the carriage is slidably mounted to the base for movement in a direction perpendicular to the line of travel, said carriage having at least two workpiece holders, one for holding a finished workpiece and the other for holding an unfinished workpiece so that as the carriage moves in a direction perpendicular to the line of travel, it can remove a workpiece from and add a workpiece to the table.

11. A method of making a line of apertures in a workpiece having a channel comprising the steps of:

positioning the workpiece on a movable table;

clamping the workpiece to the table;

moving the table incrementally through a punch press while simultaneously drawing the workpiece along a mandrel with the mandrel in the channel; and punching at least one aperture in the workpiece after each incremental movement of the table.

12. A method according to claim 11 wherein the workpiece is positioned on the movable table away from the mandrel before moving the table so that the workpiece is first drawn toward and then along the mandrel as the table moves.

* * * * *